US008051858B2

(12) United States Patent
Druzdzel

(10) Patent No.: US 8,051,858 B2
(45) Date of Patent: Nov. 8, 2011

(54) METHOD AND APPARATUS FOR CONDITIONING OF CELLULAR MATERIALS, IN PARTICULAR ORGANIC MATERIALS

(75) Inventor: Arkadiusz Druzdzel, Radom (PL)

(73) Assignee: International Tobaco Machinery Poland Ltd., Radom (PL)

( * ) Notice: Subject to any disclaimer, the term of this patent is extended or adjusted under 35 U.S.C. 154(b) by 823 days.

(21) Appl. No.: 11/634,206

(22) Filed: Dec. 6, 2006

(65) Prior Publication Data

US 2007/0125395 A1 Jun. 7, 2007

(30) Foreign Application Priority Data

Dec. 6, 2005 (PL) ..... 378287

(51) Int. Cl.
*A24B 3/00* (2006.01)
*A24B 3/18* (2006.01)

(52) U.S. Cl. ..... 131/300; 131/301; 432/14; 432/9

(58) Field of Classification Search ..... 131/291
See application file for complete search history.

(56) References Cited

U.S. PATENT DOCUMENTS 2,195,680 A * 4/1940 Richter ..... 68/62
3,879,857 A * 4/1975 Neville ..... 34/368
4,036,239 A * 7/1977 Preston et al. ..... 131/109.1
4,573,278 A * 3/1986 Ruiz-Avila ..... 34/168
4,600,021 A * 7/1986 Mattei ..... 131/110
5,908,032 A * 6/1999 Poindexter et al. ..... 131/291
6,158,441 A * 12/2000 Grigutsch et al. ..... 131/296
2004/0182404 A1* 9/2004 Poindexter et al. ..... 131/291

FOREIGN PATENT DOCUMENTS

DE 936439 C 12/1955
GB 627222 * 8/1949
GB 627222 A 8/1949

OTHER PUBLICATIONS

European Search Report, in corresponding Application No. EP 06 12 5433, dated Feb. 21, 2007 (4 pgs).
English Translation of Claims of DE 936,439 (1 pg) (1955).

* cited by examiner

*Primary Examiner* — Philip Tucker
*Assistant Examiner* — Vicki Wu

(57) ABSTRACT

Method for conditioning of cellular materials, in particular organic materials, wherein the conditioned material is exposed to the thermodynamic medium. Further into the stream of the thermodynamic medium flowing in the channel (1, 6, 8, 9, 10), using the adjustable diaphragms (4, 5, 7) there are introduced turbulences increasing relative speed between conditioned material and thermodynamic medium. Invention further relates to the apparatus for conditioning of cellular materials, in particular organic materials, comprising inlet gate and supplying channel, conditioning channel and outlet, supplied from the source of the thermodynamic medium. Further the conditioning channel (6, 8, 9) has a spiral shape.

8 Claims, 1 Drawing Sheet

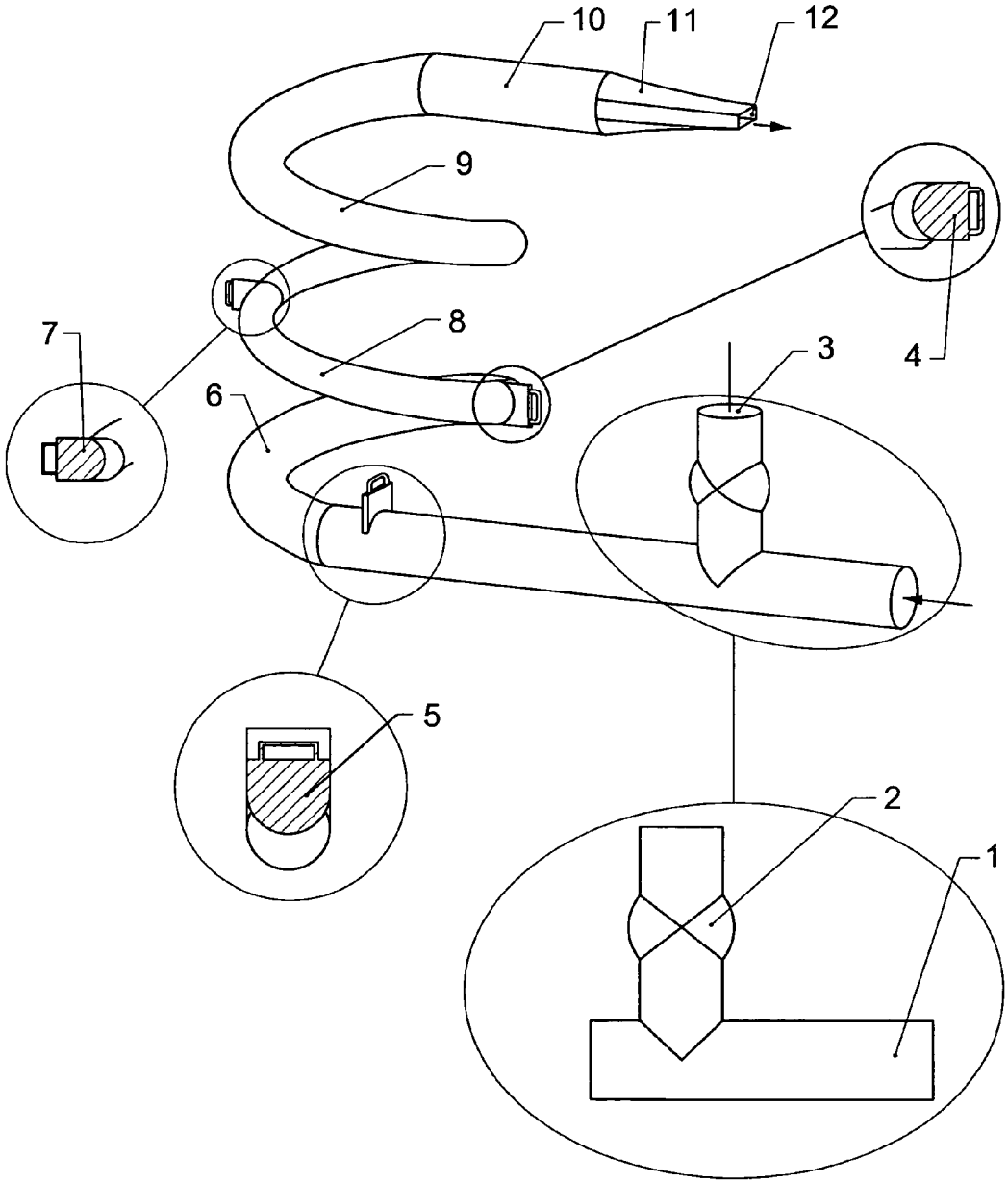
Figure

METHOD AND APPARATUS FOR CONDITIONING OF CELLULAR MATERIALS, IN PARTICULAR ORGANIC MATERIALS

Present invention relates to the method and apparatus for conditioning of cellular materials, in particular organic materials.

BACKGROUND OF THE INVENTION

In the process of conditioning of organic material, for example tobacco, it is extremely important to precisely control parameters of the conditioning process, this is particularly difficult in a case of fine particles of the organic material exposed to the thermodynamic medium of high absolute speed and high relative speed in relation to the particles being conditioned. The main problem in such process is controlling the parameters of nonlaminar stream of mass consisting of particles of the conditioned organic material and thermodynamic medium, in respect to the particular particles of the organic material.

There are several apparatus for conditioning of organic materials known in the state of the art. U.S. Pat. No. 5,908,032 discloses a method and apparatus for expansion of tobacco, which is using a channel in a form of letter C, wherein tobacco is transported by hot gaseous medium.

U.S. Pat. No. 5,711,086 discloses an apparatus for continuous drying in a superheated steam. Apparatus disclosed comprises a drying chamber and an assembly of the conveyor belts transporting material being dried. Superheated steam is generated inside the drying chamber from the moisture coming from the material being dried, as a result of exposing the material to hot gas or the moisture is introduced into to the chamber from the external source of the superheated steam.

U.S. Pat. No. 4,044,780 discloses an apparatus for expanding in volume of the cut tobacco, the apparatus comprises first unit increasing tobacco temperature and humidity to the state where tobacco particles open. Such apparatus comprises additionally separate unit for creating a thin layer of opened organic material particles in the gas atmosphere and a unit for rapid cooling.

U.S. Pat. No. 6,185,843 discloses a dryer where the transport of the organic material is carried out using pneumatic means. The shape of the inlet channel is decreasing the contact of the tobacco particles with a internal surfaces of the transport channel.

EP patent no. 1 033 081 discloses a method of expanding the food products or tobacco using superheated steam as transport medium.

SUMMARY OF THE INVENTION

According to the invention it is disclosed a method for conditioning of cellular materials, in particular organic materials, wherein the conditioned material is exposed to the thermodynamic medium. The method characterizes in that into the stream of the thermodynamic medium flowing in the channel using the adjustable diaphragms there are introduced turbulences increasing relative speed between conditioned material and thermodynamic medium.

According to the invention from the additional sources placed along the channel transporting conditioned material, there is introduced additional thermodynamic medium.

According to the invention the thermodynamic medium in a form of the steam is being superheated to the temperature in a range of 170° C. to 320° C., preferably of 170° C. to 270° C.

According to the invention the thermodynamic medium in a form of air is being superheated to the temperature in a range of 80° C. to 280° C.

According to the invention the thermodynamic medium is selected from the group comprising steam, air, any combination of the aerosols and/or vapor of the chemical compounds and/or gases such as argon, nitrogen, carbon dioxide.

Further according to the invention it is disclosed an apparatus for conditioning cellular material, in particular organic materials, comprising inlet gate and supplying channel, conditioning channel and outlet, supplied from the source of the thermodynamic medium. The apparatus comprises the conditioning channel that has a spiral shape.

According to the invention at least one section of the process channel has a shape other than circular, for example oval or ovalic.

According to the invention the conditioning channel (is divided into sections, and each of these sections has a different angle of inclination.

According to the invention each of the sections has different internal diameter, and the angle of inclination is adjustable.

According to the invention the conditioning channel is provided with regulated diaphragms introducing turbulences into the stream of the supplied thermodynamic medium.

According to the invention the conditioning channel (is provided with additional nozzles being additional sources of the thermodynamic medium introducing additional turbulences into the main stream of the thermodynamic medium.

According to the invention at least one of the sections is provided with adjustable cross section in the shape different than circular, for example oval or ovalic.

Method and apparatus according to the invention increase relative speed of thermodynamic medium and conditioned material. The increase of the relative sped between thermodynamic medium and conditioned material results in optimal values and proportions of the heat exchange rate to/from the conditioned mass and mass transport rate (for example water) to/from the conditioned material.

Method and apparatus according to the invention allows reduction of the structural dimensions of the conditioning installation of the cellular materials.

BRIEF DESCRIPTION OF THE DRAWINGS

The FIGURE shows in the perspective view the embodiment of the apparatus for conditioning of cellular materials in particular organic materials.

DETAILED DESCRIPTION OF THE INVENTION

In the preferred embodiment of the invention, cellular material is introduced into the apparatus for conditioning through the inlet 3 via inlet gate 2. At the same time through the inlet 1 of the apparatus for conditioning there is introduced thermodynamic medium of the appropriate physiochemical properties determined by the person skilled in the art of conditioning cellular materials in particular organic materials. The stream of thermodynamic medium is being directed by the conditioning channel towards outlet 11, 12.

The main stream of thermodynamic medium transports conditioned material towards the outlet, at the same time thermodynamic medium gives to the particles of the conditioned material required physiochemical and organoleptic properties.

Due to the spiral configuration of the conditioning channel 6, 8, 9 in the method according to the invention the particles of the conditioned material are moving along the spiral path. Introduction of the sections to the conditioning channel 6, 8, 9 having different cross-section, different diameters and adjustable inclination, gives favorable parameters to the flow of thermodynamic medium carrying on the conditioned material.

To minimize disadvantageous collisions of the cellular, material particles with the walls of the conditioning channel, in the method according to the invention into the main stream of thermodynamic material using adjustable diaphragms 4, 5, 7 there are introduced turbulences giving to the particles additional favorable spatial motion components. Introduction of the favorable turbulences leads to separation of the conditioned material particles from the walls of the conditioning channel.

The thermodynamic medium is a gas, preferably steam in any form, including superheated steam in the temperature of 120° C. to 320° C., preferably in a range of 170° C. to 270° C. Thermodynamic medium can be air, preferably hot air in the temperature range of 80° C. do 280° C. Thermodynamic medium may be also any combination of aerosols and/or chemical vapors, as well as gases, for example argon, nitrogen, carbon dioxide etc, which may favorably influence the conditioning process and/or give specific organoleptic properties to the conditioned material.

The apparatus for conditioning according to the invention may be supplied with different thermodynamic mediums, for example if the thermodynamic medium is air alone, preferably low humidity air, then the apparatus for conditioning being a drier. Speed of drying increases with the increase of relative speed between organic material and thermodynamic medium. Along with increase of the relative speed the Nusselt number increases which intensifies exchange heat and mass (for example water) between thermodynamic medium and organic material. Described above process parameters can be controlled by adjusting speed of circulation for thermodynamic medium.

Thermodynamic medium could be chosen from the group comprising nitrogen, argon, carbon dioxide or other non chemically inert gas, then apart from intensive drying the thermodynamic medium can be heated to the temperature allowing not only drying but which also allows expansion (swelling) of the material.

In a case when the thermodynamic medium is steam with a small addition of air, an organic material after introducing into the apparatus is moistened to the point where no condensation appears. This leads to increase of the humidity of an organic material. Keeping an organic material longer in the area of exposing to the thermodynamic medium, an organic material can be expanded, and than dried to achieve final humidity. To increase expansion of the material steam can be used, preferably superheated steam, the steam can be supplied by additional set of nozzles (not shown) placed behind the inlet gate.

In a preferred embodiment of the apparatus according to the invention, the apparatus comprises inlet 1 combined with the inlet gate 2 allowing introduction of the cellular material into the apparatus. Through inlet 1 the apparatus according to the invention is supplied with the thermodynamic medium of physiochemical parameters and thermodynamic parameters determined by the person skilled in the art of conditioning cellular materials in particular organic materials.

An apparatus according to the invention comprises conditioning channel 6, 8, 9, 10, 11 leading to the outlet 12. The conditioning channel is provided with adjustable diaphragms 4, 5, 7, which introduce turbulences into the main stream of the thermodynamic medium with cellular material, which are favorably increasing the relative speed between thermodynamic medium and cellular material particles, in particular organic material.

In another preferable embodiment of the apparatus according to the invention, the apparatus according to the invention is provided with additional sources of the thermodynamic medium (not shown) placed along conditioning channel. Additional sources of the thermodynamic medium introduce into the main stream carrying on the conditioned material additional components to the speed vector in the radial direction generating favorable vortexes and turbulences inside the conditioning channel.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. Apparatus for conditioning of cellular materials, comprising:

an inlet gate;

a supplying channel;

a spiral shaped conditioning channel; and an outlet;

thermodynamic medium being supplied as a stream to the apparatus along a flow direction from a source of thermodynamic medium;

said conditioning channel being provided with adjustable solid non-perforated diaphragms positioned in said conditioning channel transversely to said flow direction;

wherein the diaphragms are such that they cause introduction of turbulences into the stream of the thermodynamic medium thereby increasing relative speed between conditioned material and the thermodynamic medium.

2. Apparatus according to claim 1, wherein at least one section of the conditioning channel has a shape other than circular.

3. Apparatus according to claim 1, wherein the conditioning channel is divided into sections, each said section having a different angle of inclination.

4. Apparatus according to claim 3, wherein each of the sections has a different internal diameter, and the angle of inclination of the section is adjustable.

5. Apparatus according to claim 1, wherein the conditioning channel is provided with additional nozzles as additional sources of thermodynamic medium introducing additional turbulences into the stream of thermodynamic medium.

6. Apparatus according to claim 2 wherein at least one of the sections is provided with adjustable cross section in a shape different than circular.

7. Apparatus according to claim 1, wherein at least one section of the conditioning channel is oval or ovalic.

8. Apparatus according to claim 6, wherein at least one section of the conditioning channel is oval or ovalic.

* * * * *

UNITED STATES PATENT AND TRADEMARK OFFICE

CERTIFICATE OF CORRECTION

PATENT NO. : 8,051,858 B2
APPLICATION NO. : 11/634206
DATED : November 8, 2011
INVENTOR(S) : Druzdzel It is certified that error appears in the above-identified patent and that said Letters Patent is hereby corrected as shown below:

Title page of the patent, left hand Item "[73] Assignee", please delete "International Tobacco Machinery Poland Ltd." and insert --International Tobacco Machinery Poland Sp. z o.o.--

Signed and Sealed this
Third Day of January, 2012

David J. Kappos

David J. Kappos
*Director of the United States Patent and Trademark Office*